US010415525B2

(12) United States Patent
Del Rossa

(10) Patent No.: US 10,415,525 B2
(45) Date of Patent: Sep. 17, 2019

(54) FUEL INJECTOR REPAIR TOOL

(71) Applicant: Jeffrey Del Rossa, Pittsburgh, PA (US)

(72) Inventor: Jeffrey Del Rossa, Pittsburgh, PA (US)

( * ) Notice: Subject to any disclaimer, the term of this patent is extended or adjusted under 35 U.S.C. 154(b) by 12 days.

(21) Appl. No.: 15/958,534

(22) Filed: Apr. 20, 2018

(65) Prior Publication Data

US 2018/0306153 A1 Oct. 25, 2018

Related U.S. Application Data

(60) Provisional application No. 62/488,111, filed on Apr. 21, 2017.

(51) Int. Cl.

| | |
|---|---|
| ***F02M 61/14*** | (2006.01) |
| ***B25B 27/00*** | (2006.01) |
| ***B25B 27/02*** | (2006.01) |

(52) U.S. Cl.

CPC ..... *F02M 61/14* (2013.01); *B25B 27/0035* (2013.01); *B25B 27/023* (2013.01); *F02M 2200/855* (2013.01); *F02M 2200/856* (2013.01)

(58) Field of Classification Search

CPC ..... B25B 27/023; B25B 27/0035; F02M 2200/855; F02M 61/14; F02M 2200/856

See application file for complete search history.

(56) References Cited

U.S. PATENT DOCUMENTS

| | | | | |
|---|---|---|---|---|
| 6,431,152 | B1 * | 8/2002 | Estacio | F02M 61/14 123/470 |
| 6,863,053 | B2 * | 3/2005 | Suzuki | F02M 55/025 123/456 |
| 2003/0033714 | A1 * | 2/2003 | King | B25B 27/0035 29/888.011 |
| 2009/0007734 | A1 * | 1/2009 | Lulewicz | B25B 7/00 81/415 |
| 2013/0042473 | A1 * | 2/2013 | Imam | B25B 27/0035 29/888.011 |

OTHER PUBLICATIONS https://www.otctools.com/products/gm-duramax-injector-puller.
http://www.freedomracing.com/fuel-injector-remover.
https://www.rotundatechtools.com/rotunda/Tools/Product-Categories/Vehicle-Specialty-Tools/Fuel-System.

* cited by examiner

*Primary Examiner* — Xiao En Mo
(74) *Attorney, Agent, or Firm* — Buchanan Ingersoll & Rooney PC

(57) ABSTRACT

A tool for removing fuel injectors from a head assembly is disclosed that is comprised of a bolt, a dual-tined fork, and a plate that fit into the existing hold-down bolt holes in a head assembly and grooves in the fuel injectors.

10 Claims, 5 Drawing Sheets

FUEL INJECTOR REPAIR TOOL

This application claims the benefit of U.S. Provisional Patent Application No. 62/488,111, filed on Apr. 21, 2017, the contents of which are hereby incorporated herein by reference.

FIELD OF THE INVENTION

The present invention generally relates to an apparatus for removing a fuel injector from a cylinder head assembly in an engine.

BACKGROUND OF THE INVENTION

Modern gas and diesel internal combustion engines require precise control of fuel delivery to a combustion chamber in order to operate at peak performance (such as efficiency, power, reliability, etc.). This fuel control is typically accomplished via a fuel injector, which provides a mechanism for reliably and accurately injecting fuel into the combustion chamber of internal combustion engine, such as one found in automotive and truck engines, for example. Fuel injectors require frequent service to operate efficiently in dispersing precise amounts of fuel into the combustion chamber. The life cycle of the fuel injector depends on the ability to provide consistent fuel pressure and cylinder head pressure to deliver fuel at incremental moments as determined by the engine's controls and requirements.

Fuel injectors are typically mounted onto an engine either by inserting a threaded injector into a tapped hole or by a retaining assembly, and they are positioned such that the injector can deliver fuel directly into the combustion chamber. The retaining assembly typically consists of a small dual fork-like object that straddles the fuel injector and is secured via a mounting bolt that passes through a hold-down bolt hole in the valve cover and into a threaded mounting hole in the cylinder head.

To repair or remove such a fuel injector, one normally must remove the mounting bolt that passes through the valve cover that is secured to the cylinder head. The retaining fuel injector fork is then removed with the mounting bolt and replaced with a fuel injector removal tool that passes through the same hold-down bolt hole in the valve cover and is secured to the cylinder head via the threaded mounting bolt hole in the cylinder head. The fuel injector removal tool typically has a separate fork that fits onto and around machined flats in the side of the fuel injector. An additional fastener is threaded into the top of the assembly. By rotating the additional fastener, the fork is raised, which raises the fuel injector and allows the user to remove the fuel injector.

This method has its own problems, however. First, it requires passing the fuel injector removal tool through the hold-down bolt hole in the valve cover and threading and unthreading it into the threaded mounting hole in the cylinder head assembly, which creates an opportunity for the tool to damage or get stuck in the mounting hole. Either problem will greatly increase the time and cost of replacing the fuel injector. Second, the process is more time-consuming than it needs to be, because the fuel injector removal tool must pass through the valve cover injector mounting hole and then be screwed and unscrewed from the cylinder head.

SUMMARY OF THE INVENTION

Embodiments of the disclosed invention avoid or minimize some of these issues by facilitating the removal of the fuel injector while the cylinder head assembly and mating components remain fixed in the vehicle and without the need to screw any tools into the mounting holes or to secure them to the cylinder head. This invention avoids the dangers of threading and unthreading a tool into the mounting hole and cylinder head and can allow the assembly to be repaired in an even shorter amount of time, which reduces the time and cost of repairs and minimizes the risk of damaging the mounting valve cover, mounting hole, and cylinder head.

In one embodiment of the invention, an apparatus for removing a fuel injector, comprising: a threaded bolt with a threaded portion, a cap, and a tip, wherein the cap and the tip are located on opposite ends of the threaded bolt; a fork comprising a threaded hole and a pair of tines, wherein the threaded hole and the pair of times are located on opposites ends of the fork; a plate with a top surface, a bottom surface, a dimple, and a plug, wherein the dimple is located in the top surface and the plug extends from the bottom surface; wherein the threaded portion of the threaded bolt engages the threaded hole and the tip of the threaded bolt engages the dimple.

A method for removing a fuel injector with grooves using an embodiment of the invention comprises: removing a fuel injector hold-down bolt from a fuel injector hold-down bolt hole; removing a fuel injector hold-down fork from the fuel injector; placing a tool comprised of a threaded bolt with a threaded portion, a cap, and a tip, wherein the cap and the tip are located on opposite ends of the threaded bolt; a fork comprising a threaded hole and a pair of tines, wherein the threaded hole and the pair of times are located on opposites ends of the fork; and a plate with a top surface, a bottom surface, a dimple, and a plug, wherein the dimple is located in the top surface and the plug extends from the bottom surface; into the fuel injector hold-down bolt hole and the grooves in the fuel injector, wherein the threaded bolt is threaded into the threaded hole, the plug is placed in the fuel injector hold-down bolt hole, the tines are placed around the grooves in the fuel injector, and the dimple is aligned with the tip; and rotating the threaded bolt.

DESCRIPTION OF THE INVENTION

Figure 1:
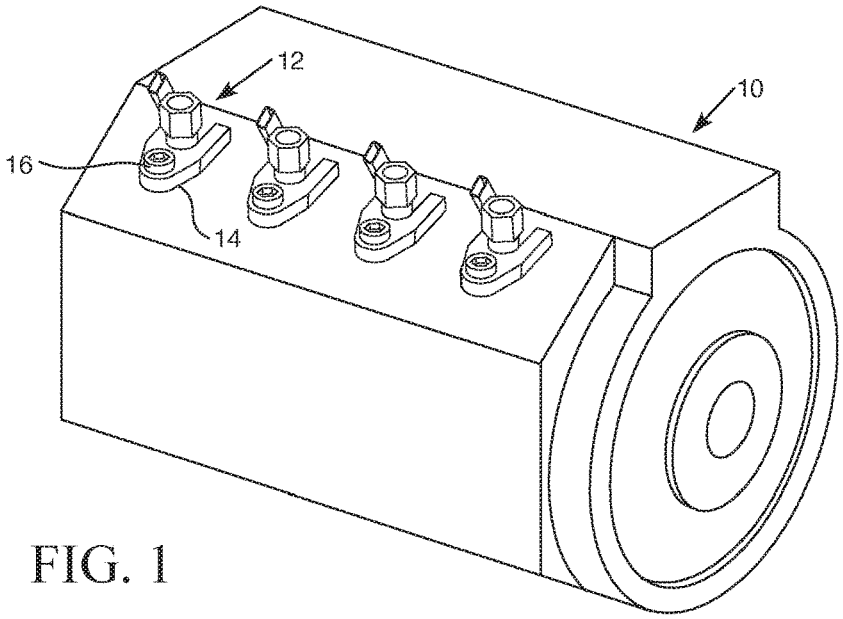
FIG. 1 is an outer view of a head assembly with multiple fuel injectors.
Figure 2:
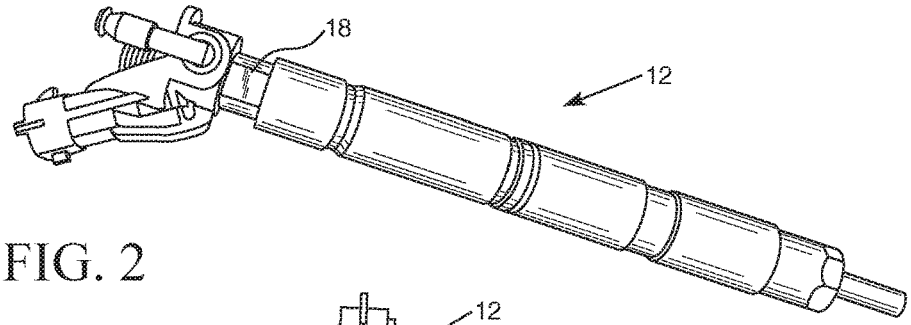
FIG. 2 is a side view of a fuel injector showing machined flats or grooves.
Figure 3:
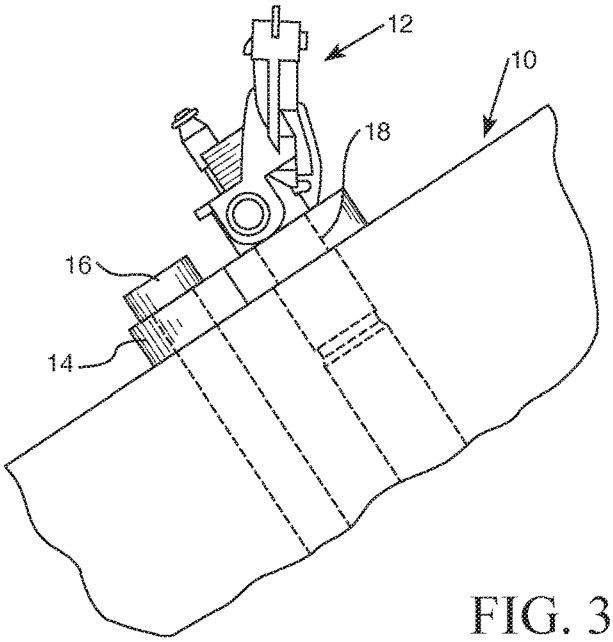
FIG. 3 is side view of a fuel injector and hold-down fork in a head assembly.
Figure 4A:
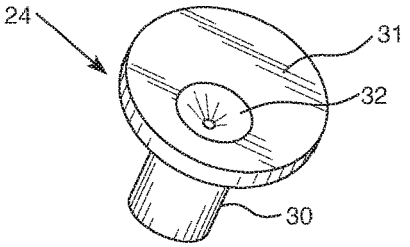
FIG. 4(*a*)-(*d*) are various views of a plate—(a) perspective, (b) top, (c) bottom, and (d) side.
Figure 4B:
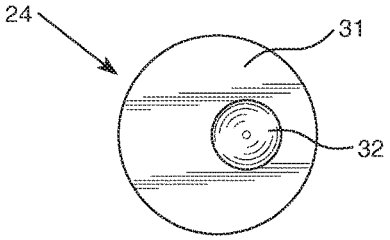
Figure 4C:
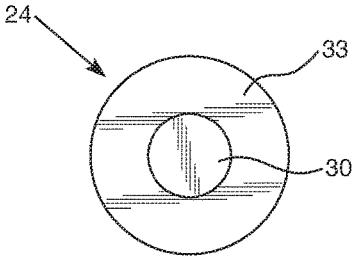
Figure 4D:
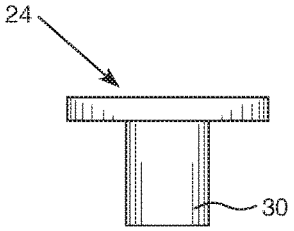
Figure 8:
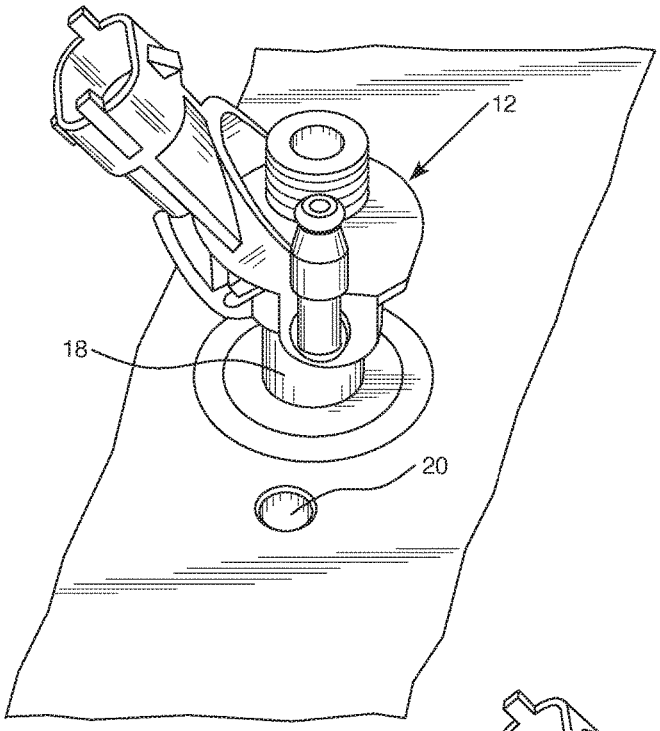
FIG. 8 is view of a fuel injector and hold-down bolt hole in a head assembly with a hold-down fork and bolt removed.

A diesel engine cylinder head assembly 10 is shown in FIG. 1. A fuel injector 12 passes through and into head assembly 10. Fuel injector 12 is secured onto head assembly 10 by a fuel injector hold-down fork 14, which has tines that fit around machined flats or grooves 18 in fuel injector 12 (as shown in FIGS. 1-3). Hold-down fork 14 is secured to head assembly 10 via a fuel injector hold-down bolt 16. Hold-down bolt 16 passes through fuel injector hold-down bolt hole 20 (shown in FIG. 8) and screws into a threaded mounting hole inside head assembly 10. Note that there is generally more than one fuel injector in a head assembly, so there will be multiple holes into which the fuel injectors and hold-down bolts are secured.

One embodiment of the present invention is shown in FIGS. 4-7. This embodiment is comprised of three discrete elements—a generally cylindrical plate 24, a threaded fork 26, and a lift bolt 28—and collectively plate 24, fork 26, and lift bolt 28 form a new fuel injector removal tool 22.

Lift bolt or screw 28 has a typical bolt shape for a ½" diameter shaft, with a threaded portion 42 near tip 38 and cap 40 with a hexagonal socket 41 that can accept an Allen wrench 44 on the opposite end. In this example, it is approximately 3¼" in length from tip to tip. Cap 40 could alternatively be shaped to fit other traditional bolt head patterns, such as square, crossed, slotted, star-shaped, or other shapes that can accommodate tools of various types, and tip 38 could take on different shapes, such as a rounded end or a more pointed end. Other lengths could also be used, as desired.

Figure 5A:
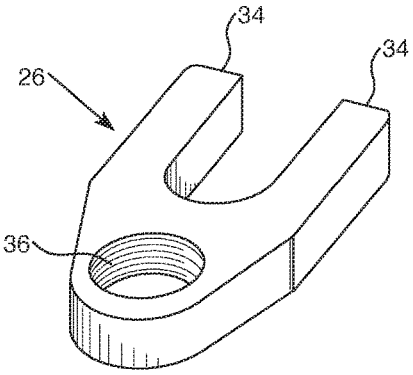
FIG. 5(*a*)-(*c*) are various views of a fork—(a) perspective, (b) top, and (c) side.
Figure 5B:
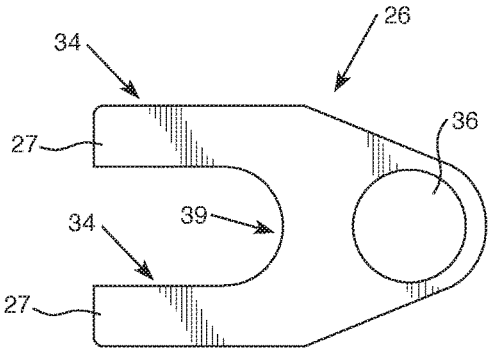
Figure 5C:
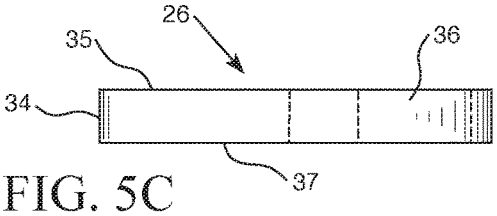
Figure 6:
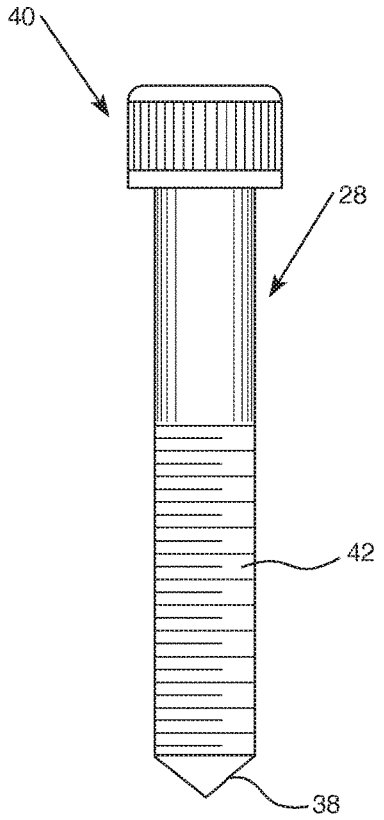
FIG. 6 is a side view of a lift bolt.
Figure 7:
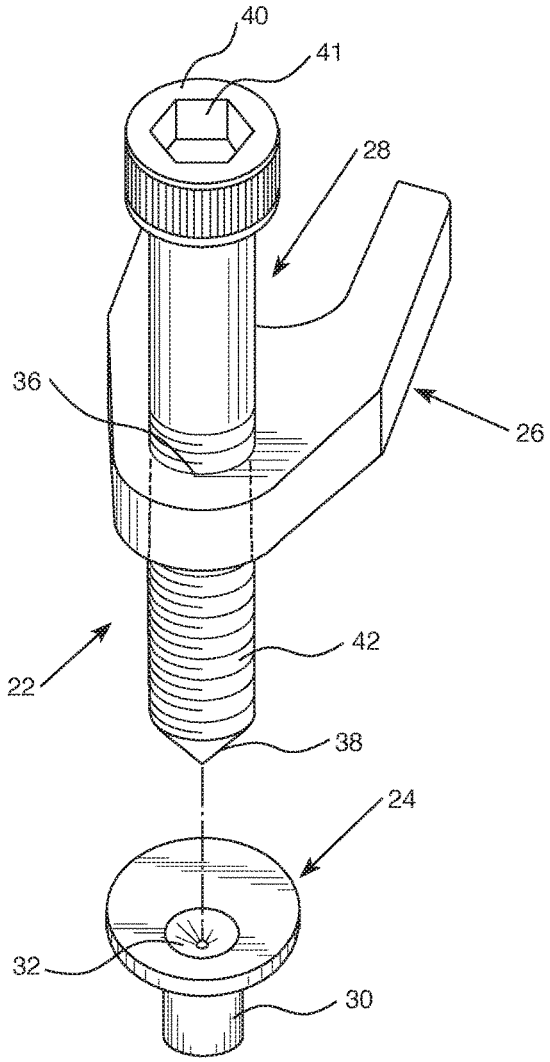
FIG. 7 is a perspective view of an assembled fuel injector removal tool.

Fork 26 has two tines 34 that are spaced so that there is an approximately 9/16" gap between the tines in order to securely fit into flats 18 in fuel injector 12. Fork 26 is approximately ⅜" high×1¾" long×1" wide in its longest extents. Tines 34 are approximately ¼" wide. The far ends 27 of tines 34 of fork 26 are flat, but the opposite ends of tines 34 near the center of fork 26 converge into a semi-circular region 39, which allows fork 26 to mate securely with fuel injector 12 to provide maximal contact between fork 26 and fuel injector 12 during use. This maximal contact allows fork 26 to transfer more force to fuel injector 12 during the removal process. Fork 26 can be in other sizes, shapes, and dimensions, as long as tines 34 create a sufficient gap to fit into and around flats 18 in fuel injector 12. Fork 26 also has a ½" diameter threaded hole 36 sized and threaded to accept lift bolt 28. As shown in FIG. 5(*b*), threaded hole 36 is located at the opposite end of fork 26 as tines 34 and passes through the entirety of fork 26 (from top surface 35 to bottom surface 37) so that lift bolt 28 can be threaded into and through threaded hole 36.

Plate or pad 24 is generally circular in shape (although other shapes could also be used—such as square, pentagonal, octagonal, etc.) and has a cylindrical plug 30 extending from the bottom surface 33 of plate 24 and a dimple (or machined recess) 32 extending into the top surface 31 of plate 24. The top disc-shaped portion of plate 24 is approximately ⅞" in diameter, with a thickness of approximately 1/16". The diameter of plug 30 is such that it will fit comfortably and securely into hold-down bolt hole 20 so that there is little movement of plug 30 when it is in hold-down bolt hole 20. In this example, plug 30 is approximately 11/32" in diameter and 7/16" long. While plug 30 is centered on plate 24 in this embodiment, it does not have to be. Other shapes, sizes, and dimensions of plate 24 could be used and fall within the scope of the invention.

Dimple 32 is sized to accept tip 38 on lift bolt 28. In this example, it is approximately ¼" in diameter and 1/16" deep. Dimple 32 is generally semi-spherical in shape, although it can be more tapered or cone-shaped, as well. In this example (as shown in FIG. 4(*b*)), semi-spherical dimple 32 is not centered in plate 24. Instead, it is offset by approximately by 1/16" so that it can accept tip 38 when lift bolt 28 is threaded through threaded hole 36 and minimize the walk-off or creep of lift bolt 28. Dimple 32 could be located in different positions on plate 24, such as in the center or further or closer to the center, so long as it is positioned to accept tip 38 in lift bolt 28. But, an offset dimple 32 has been found to provide the optimal performance and is superior to centered designs. Dimple 32 is offset due to the geometry of the tool because it is also offset from center, which has a twofold mechanical purpose. First, distributes the load from lift bolt 28. Second, it secures fork 26 so it will not walk or creep away from the injector during use. This offset keeps fork 26 perpendicular (90°) to the head assembly, thereby delivering the maximum force to release the fuel injector 12 during operation. This offset design helps this tool solve some of the problems with other tools in the market, which will walk away from the fuel injector during use and bend the mounting bolt that passes through the valve cover.

Plate 24, fork 26, and lift bolt 28 are made of hardened steel that is then black oxide coated and hardened again. While other materials could be used, the characteristics of the material are important because of the strength and resistance to deformation that are needed for the embodiment to function optimally. So, other materials that have similar (or greater) strength and resistance to deformation could also be used.

The sizes and shapes of plate 24, fork 26, and lift bolt 28 have been optimized to fit in and around the cavities in the valve cover and work with the fuel injectors in a Ford 6.7 L diesel engine. However, this tool could also work with other engines that mount and secure fuel injectors in a similar fashion as the Ford 6.7 L diesel engine does, but the sizes and shapes of plate 24, fork 26, and lift bolt 28 may need to be adjusted to accommodate any relevant differences in the engines and fuel injectors.

Figure 9:
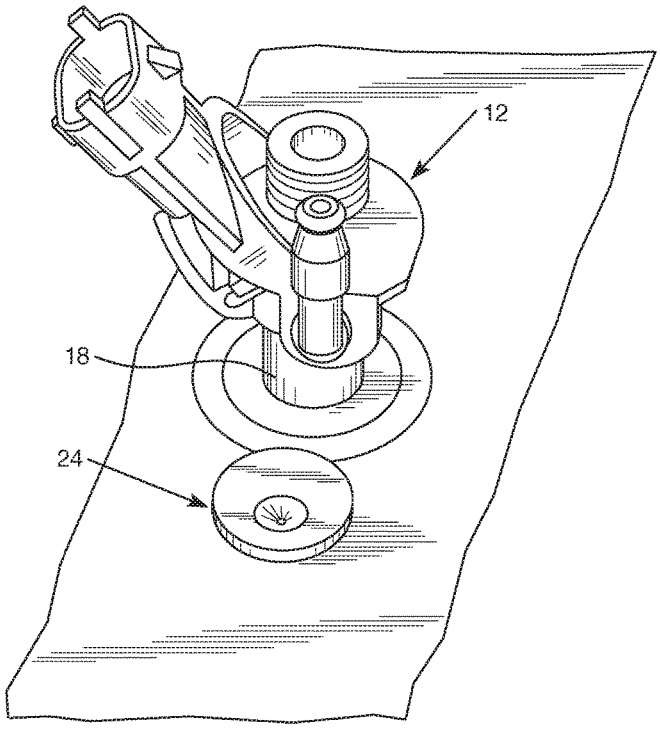
FIG. 9 is a view of a fuel injector in a head assembly with a plate inserted into a mounting hole.
Figure 10:
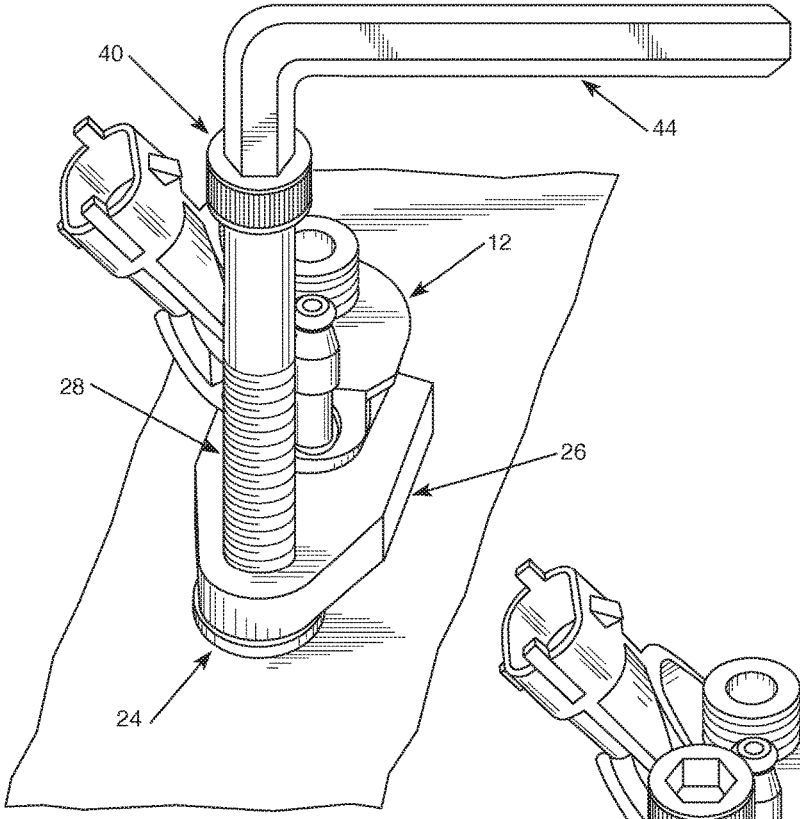
FIG. 10 is view of a fuel injector removal tool around a fuel injector.
Figure 11:
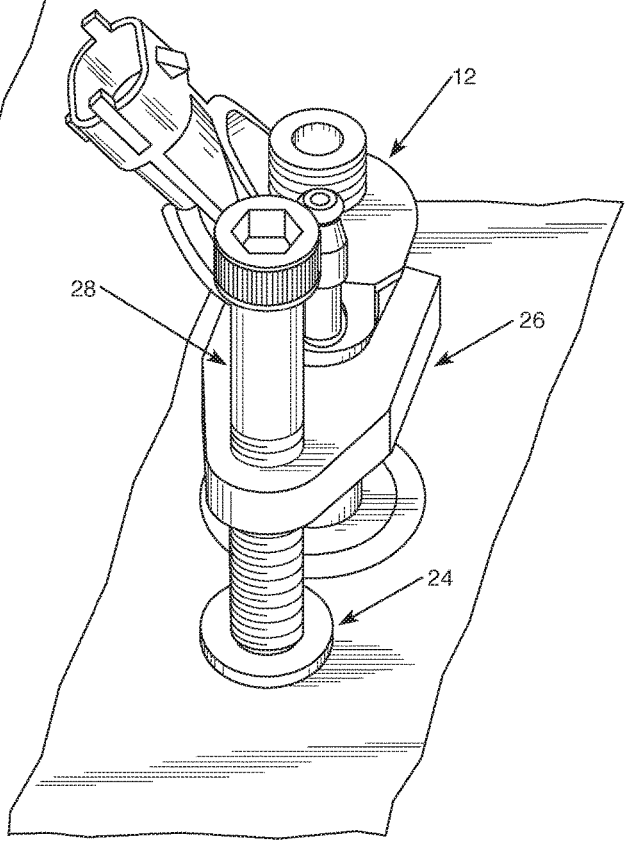
FIG. 11 is view of a fuel injector removal tool removing a fuel injector.

In order to use an embodiment of the invention, a user must first remove fuel injector hold-down bolt 16 from bolt hole 20 on head assembly 10 and then remove fuel injector hold-down fork 14 from fuel injector 12. Once those pieces are removed, fuel injector 12 and fuel injector hold-down bolt hole 20 will be exposed (see FIG. 8). The user then places plate 24 into bolt hole 20 with dimple 32 facing up and out and plug 30 facing into bolt hole 20 (see FIG. 9). Fork 26 is placed into grooves 18 in fuel injector 12 and rotated so that threaded hole 36 roughly aligns with dimple 32 in plate 24. Note that plate 24 may need to be rotated to obtain the best engagement. Next, lift bolt 28 is threaded into threaded hole 36 so that tip 38 engages dimple 32 in plate 24 (see FIG. 10). Alternatively, lift bolt 28 can be pre-threaded into fork 26 before placing fork 26 around flats 18. As mentioned above, dimple 32 helps to keep lift bolt 28 engaged with plate 24 and minimizes the chance of walk-off of lift bolt 28 during operation. The user places an Allen wrench 44 into socket 41 and rotates the wrench in a clockwise manner to rotate lift bolt 28. As the user does so, lift bolt 28 pushes down into plate 24, thereby lifting fork 26 and fuel injector 12 (see FIG. 11). Once fuel injector 12 has been lifted a sufficient distance to become loose (which depends on how firmly it is seated into head assembly 10), the user can remove fuel injector 12. Plate 24 is then removed from bolt hole 20. A new fuel injector (or a cleaned fuel injector) can be placed back into head assembly 10, and the fuel injector hold-down assembly can be reattached.

Because plug 30 on plate 24 is cylindrical, not threaded, and only extends for a limited distance into hold-down bolt hole 20, it will not damage either hold-down bolt hole 20 or the mounting hole inside head assembly 10 when it is inserted into hold-down bolt hole 20. This design protects the threaded holes in head assembly 10 and minimizes the risk of damaging them and creating further work for the user, thereby saving the user time (and the ultimate customer money). Further, because lift bolt 28 does not need to be threaded all the way down into the mounting hole inside the head assembly, the user saves additional time in removing the fuel injector and avoids the potential of stripping or damaging the mounting hole inside the head assembly.

The foregoing description has been presented for purposes of illustration and description, and is not intended to be exhaustive or to limit the invention to the precise form disclosed. The descriptions were selected to explain the principles of the invention and their practical application to enable others skilled in the art to utilize the invention in various embodiments and various modifications as are suited to the particular use contemplated. Although particular constructions of the present invention have been shown and described, other alternative constructions will be apparent to those skilled in the art and are within the intended scope of the present invention.

What is claimed is:

1. An apparatus for removing a fuel injector, comprising:

a threaded bolt with a threaded portion, a cap, and a tip, wherein the cap and the tip are located on opposite ends of the threaded bolt;

a fork comprising a threaded hole and a pair of tines, wherein the threaded hole and the pair of tines are located on opposites ends of the fork;

a plate with a top surface, a bottom surface, a dimple, and a plug, wherein the dimple is located in the top surface and the plug extends from the bottom surface;

wherein the threaded portion of the threaded bolt engages the threaded hole and the tip of the threaded bolt engages the dimple.

2. The apparatus of claim 1, wherein the dimple is offset from the center of the plate.

3. The apparatus of claim 1, wherein the plate is generally circular and the plug is cylindrical.

4. The apparatus of claim 1, wherein the cap contains a hexagonal socket.

5. A method for removing a fuel injector with grooves comprising:

removing a fuel injector hold-down bolt from a fuel injector hold-down bolt hole;

removing a fuel injector hold-down fork from the fuel injector;

placing a tool comprised of a threaded bolt with a threaded portion, a cap, and a tip, wherein the cap and the tip are located on opposite ends of the threaded bolt;

a fork comprising a threaded hole and a pair of tines, wherein the threaded hole and the pair of tines are located on opposites ends of the fork; and a plate with a top surface, a bottom surface, a dimple, and a plug, wherein the dimple is located in the top surface and the plug extends from the bottom surface;

into the fuel injector hold-down bolt hole and the grooves in the fuel injector, wherein the threaded bolt is threaded into the threaded hole, the plug is placed in the fuel injector hold-down bolt hole, the tines are placed around the grooves in the fuel injector, and the dimple is aligned with the tip; and rotating the threaded bolt.

6. The method of claim 5, wherein the dimple is offset from the center of the plate.

7. The method of claim 5, further comprising a hexagonal socket in the cap and wherein the step of rotating the threaded bolt is further comprised of placing a wrench into the hexagonal socket and rotating the wrench.

8. A system, comprising:

an internal combustion engine;

a fuel injector partially extending into the internal combustion engine, wherein the fuel injector has parallel flat surfaces on the portion of the fuel injector that does not extend into the internal combustion engine;

a hold-down bolt hole in the internal combustion engine located next to the fuel injector;

an apparatus comprising a threaded bolt with a threaded portion, a cap, and a tip, wherein the cap and the tip are located on opposite ends of the threaded bolt;

a fork comprising a threaded hole and a pair of tines, wherein the threaded hole and the pair of tines are located on opposites ends of the fork and wherein the fork engages the flat surfaces of the fuel injector; and a plate with a top surface, a bottom surface, a dimple, and a retaining plug, wherein the dimple is located in the top surface and the retaining plug extends from the bottom surface, wherein the dimple is offset from the center of the plate, and wherein the retaining plug is placed in the hold-down bolt hole;

wherein the threaded portion of the threaded bolt engages the threaded hole and the tip of the threaded bolt engages the dimple to lock the apparatus in place and restrict its movement; and a tool coupled to the cap.

9. The system of claim 8, wherein the tool is a wrench.

10. The system of claim 8, wherein the plate is generally circular, the retaining plug is cylindrical, and the cap contains a hexagonal socket.

* * * * *